US011124919B2

(12) United States Patent
Coe et al.

(10) Patent No.: US 11,124,919 B2
(45) Date of Patent: Sep. 21, 2021

(54) SYSTEM FOR FABRICATING STRANDED CABLE AND CONTROL THEREFOR

(71) Applicant: TENSOR MACHINERY LTD., Montreal (CA)

(72) Inventors: Raymond Coe, Montreal (CA); Allan Browne, Montreal (CA); Krasimir Ivanov, Montreal (CA)

(73) Assignee: Tensor Machinery Ltd., Montreal (CA)

( * ) Notice: Subject to any disclaimer, the term of this patent is extended or adjusted under 35 U.S.C. 154(b) by 154 days.

(21) Appl. No.: 16/374,169

(22) Filed: Apr. 3, 2019

(65) Prior Publication Data

US 2019/0308843 A1 Oct. 10, 2019

Related U.S. Application Data

(60) Provisional application No. 62/652,427, filed on Apr. 4, 2018.

(51) Int. Cl.

| | |
|---|---|
| ***D07B 3/02*** | (2006.01) |
| ***B65H 49/34*** | (2006.01) |
| ***B65H 54/02*** | (2006.01) |
| ***B65H 49/32*** | (2006.01) |
| ***D07B 3/10*** | (2006.01) |
| ***D07B 3/06*** | (2006.01) |

(52) U.S. Cl.

CPC ..... *D07B 3/02* (2013.01); *B65H 49/32* (2013.01); *B65H 49/34* (2013.01); *B65H 54/02* (2013.01); *D07B 3/06* (2013.01); *D07B 3/10* (2013.01)

(58) Field of Classification Search

CPC ... D07B 3/02; D07B 3/06; B65H 4/02; B65H 49/32; B65H 49/34

See application file for complete search history.

(56) References Cited

U.S. PATENT DOCUMENTS

| | | | | |
|---|---|---|---|---|
| 3,405,443 | A * | 10/1968 | Jore | H02G 11/003 29/828 |
| 6,840,031 | B2 * | 1/2005 | Blackmore | H01B 13/0285 57/58.52 |
| 6,948,304 | B2 * | 9/2005 | Blackmore | D07B 3/045 57/314 |
| 9,303,355 | B2 * | 4/2016 | Willson | F16H 3/44 |
| 2007/0095042 | A1 * | 5/2007 | Bieszczad | B65H 81/08 57/3 |
| 2014/0087912 | A1 * | 3/2014 | Willson | D07B 7/06 475/298 |
| 2018/0320312 | A1 * | 11/2018 | Wenzel | D07B 7/06 |

* cited by examiner

*Primary Examiner* — Shaun R Hurley
(74) *Attorney, Agent, or Firm* — Snell & Wilmer L.L.P.

(57) ABSTRACT

A strander apparatus includes a disk and a plurality of cradles, each of the cradles includes a reel and a cradle shaft, the cradle shaft extending in an axial direction from the disk. Each reel dispenses cable. The strander includes a main shaft, wherein the cradles are disposed on the cradle shafts radially about the main shaft. Planetary gears are disposed between the main shaft and the plurality of cradle shafts. The strander operates in one of a planetary mode and a rigid mode. In the planetary mode, while the main shaft rotates, the planetary gears are engaged to rotate each of the plurality of cradles on the respective cradle shafts. In the rigid mode, the planetary gears are disengaged.

45 Claims, 15 Drawing Sheets

SYSTEM FOR FABRICATING STRANDED CABLE AND CONTROL THEREFOR

CROSS-REFERENCE TO RELATED APPLICATION

This application claims priority to U.S. Provisional Patent Application No. 62/652,427, filed Apr. 4, 2018, the entire disclosure of which is incorporated herein by reference.

TECHNICAL FIELD

The present subject matter relates to machinery for fabrication of stranded wire, and, more particularly, to in-line planetary stranders and control therefor.

BACKGROUND

In industries and/or applications utilizing transfer of electricity, light, and/or information through a transmission cable, the cross-sectional area of the transmission cable may, in part, determine the speed and volume of transfer. While cross-sectional area of transmission cables and the effect thereof on speed and volume of transmission is one consideration, the durability and flexibility of the transmission cable(s) is also a concern. It is desirable to strand together subunits such as fibers, cables, wires, glass, plastic, etc., to fabricate a stranded cable formed from several intertwined subunits. Stranded cable may exhibit increased flexibility as compared with a solid cable of similar thickness, i.e., cross-sectional area. Additionally, for certain subunit materials, stranded cables are less brittle, more durable, and, occasionally, easier to manufacture. For instance, the glass or plastic subunits used for fiber optic cable may be more flexible, in part, due to the relative thinness thereof.

Stranding may be performed by planetary stranders or rigid, yarn-server stranders. In the current state of the art, different stranders are designated for use with different types of cable subunits. For example, planetary stranders may be desirable for fiber optic subunits while yarn-server stranders may, instead, be desirable for copper wire subunits. However, it is not always the case that manufacturers use only one type of subunit during production runs.

The description provided in the background section should not be assumed to be prior art merely because it is mentioned in or associated with the background section. The background section may include information that describes one or more aspects of the subject technology.

SUMMARY

According to aspects of the present disclosure, a six-position strander apparatus includes a plurality of cradles, a plurality of reels for dispensing subunits, a disk, a main shaft, and a plurality of cradle shafts. In accordance with the six-position strander apparatus, the cradles are disposed on the cradle shafts radially about the main shaft, planetary gears are disposed between the main shaft and the plurality of cradle shafts, and, while the main shaft rotates, the planetary gears engage to rotate each of the plurality of cradles on the cradle shafts. Still further, the planetary gears are disengaged when the plurality of cradles are pinned to the disk.

According to another aspect, a strander apparatus includes a disk and a plurality of cradles, each of the cradles includes a reel and a cradle shaft, the cradle shaft extending in an axial direction from the disk. Each reel dispenses cable. The strander includes a main shaft, wherein the cradles are disposed on the cradle shafts radially about the main shaft. Planetary gears are disposed between the main shaft and the plurality of cradle shafts. The strander operates in one of a planetary mode and a rigid mode. In the planetary mode, while the main shaft rotates, the planetary gears are engaged to rotate each of the plurality of cradles on the respective cradle shafts. In the rigid mode, the planetary gears are disengaged. In an embodiment, the strander apparatus is a six-position strander and the plurality of cradles includes six cradles. In an embodiment, in the rigid mode, the plurality of cradles are pinned to the disk. In an embodiment, the dispensed cable includes at least one of wire, glass, plastic, and fibers. In an embodiment, when operating in the planetary mode the cradles of the plurality of cradles maintain a same orientation relative to a particular plane. In an embodiment, when operating in the rigid mode the cradles of the plurality of cradles maintain a same orientation relative the main shaft. In an embodiment, each of the cradles includes a dancer assembly. In an embodiment, each of the cradles includes a wireless module, wherein the wireless module is associated with at least one of the cradle, reel, and dancer assembly. In an embodiment, the strander apparatus includes a controller, wherein the controller communicates with at least one of the cradle, the reel, or the dancer assembly with the associated wireless module.

According to another aspect, a six-position stranding system includes at least one cradle, at least one reel, at least one dancer assembly, a plurality of wireless modules, and at least one controller. In accordance with this aspect, the controller communicates with the at least one cradle, the at least one reel, and the at least one dancer assembly by way of associated wireless modules of the plurality of wireless modules.

According to another aspect, a stranding system includes a main shaft, and at least one cradle disposed along the main shaft. Each cradle includes: at least one reel, at least one dancer assembly, and at least one wireless module. The at least one wireless module is associated with at least one of the cradle, reel, and dancer assembly; and at least one controller. The controller communicates with the at least one cradle, the at least one reel, or the at least one dancer assembly with the associated at least one wireless module. In an embodiment, the stranding system is a six-position strander. In an embodiment, the at least one cradle includes six cradles. In an embodiment, the controller is a main controller, wherein each of the at least one cradle has a cradle controller, and wherein each cradle controller is wirelessly controlled by the main controller. In an embodiment, feedback is received from one of the at least one reel and the at least one dancer assembly by the cradle controller, and the cradle controller wirelessly transmits the feedback to the main controller. In an embodiment, the stranding system operates in a planetary mode or a rigid mode.

According to yet another aspect, a stranding system includes a first strander having a first plurality of cradles operatively coupled to a first main shaft and a second strander having a second plurality of cradles operatively coupled to a second main shaft. Further, each of the first and second pluralities of cradles have disposed thereon a reel for dispensing cables, and the first and second stranders are disposed in-line with one another such that the first strander produces stranded cable that is used as a core about which the second strander dispenses the cables. In an embodiment, the first and second stranders are both six-position stranders. In an embodiment, the first and second pluralities of cradles each comprise six cradles. In an embodiment, the stranding system includes a main controller, wherein each of the first and second stranders is remote from the main controller. In an embodiment, each of the cradles of the first and second pluralities of cradles includes a cradle controller and a wireless module. In an embodiment, the main controller wirelessly communicates with the cradle controller of each of the cradles through a wireless network to which the wireless module connects. In an embodiment, the main controller wirelessly synchronizes at least one motor associated with the first and second pluralities of cradles. In an embodiment, the first and second stranders operate in one of a planetary mode and a rigid mode. In an embodiment, the first and second stranders include gears to mechanically control movement of the reels disposed on each of the cradles of the first and second pluralities of cradles.

Still another aspect of the present disclosure describes a strander including one or more cradles, each having a reel, a reel motor, a dancer, a dancer motor, a loadcell, and a cradle controller. Also according to this aspect, the reel motor and the dancer motor are wirelessly controlled by the cradle controller. Additionally, a main shaft, a cradle motor, and a main controller are disposed such that the cradle motor rotates the main shaft and the one or more cradles disposed thereabout, and further such that the respective cradle controllers and the cradle motor are wirelessly controlled by the main controller. In an embodiment, the strander includes a plurality of gears for engaging the one or more cradles. In an embodiment, the strander has more than one operational mode. In an embodiment, the more than one operational mode includes a planetary mode and a rigid mode. In an embodiment, the plurality of gears engage the one or more cradles during operation of the strander in the planetary mode. In an embodiment, the plurality of gears are disengaged with the one or more cradles during operation of the strander in the rigid mode. In an embodiment, the strander includes at least one disk disposed on the main shaft proximal the one or more cradles. In an embodiment, the one or more cradles are pinned to the at least one disk during operation in the rigid mode. In an embodiment, each of the cradle controllers associated with each of the one or more cradles includes a wireless module. In an embodiment, feedback from one of the reel motor, the dancer motor, and the loadcell is wirelessly transmitted to the main controller. In an embodiment, the reel motor, the dancer motor, and the loadcell are synchronized by the main controller.

Also in accordance with another aspect of this disclosure, a control system for a strander includes at least one controller, a plurality of cradles disposed about respective cradle shafts, and a plurality of loadcells associated with the plurality of cradles and disposed proximal the cradle shafts. Additionally, each loadcell of the plurality of loadcells includes at least one sensor in wireless communication with the at least one controller and a plurality of reels disposed on respective cradles of the plurality of cradles. Further, the control system operates such that the plurality of reels are wirelessly controlled by the at least one controller in response to the at least one sensor of the loadcells. In an embodiment, the at least one controller includes a plurality of cradle controllers and a main controller. In an embodiment, the plurality of cradle controllers wirelessly communicate with the main controller. In an embodiment, the control system includes a plurality of wireless modules. In an embodiment, the control system includes a plurality of motors controlled by each of the plurality of cradle controllers. In an embodiment, each of the plurality of cradles includes one or more motors controlled by the respective cradle controller of the plurality of cradle controllers. In an embodiment, each of the plurality of motors is wirelessly controlled by the main controller. In an embodiment, the plurality of motors comprises at least a cradle motor, a reel motor, and a dancer motor.

According to a further aspect, a method of producing stranded cables includes rotating a main shaft of a strander with a plurality of cradles disposed thereabout, dispensing cable from respective reels disposed on each of the plurality of cradles, and operating the strander in one of a planetary mode and a rigid mode. According to this method, in the planetary mode, planetary gears engage the plurality of cradles such that the cradles are rotated coincident with the main shaft, and in the rigid mode, the planetary gears are disengaged such that the plurality of cradles are maintained in a same orientation relative to the rotating main shaft. In an embodiment, in the planetary mode the dispensed cable is twisted about an axis of the main shaft. In an embodiment, in the rigid mode the dispensed cable is twisted relative to an axis thereof and about an axis of the main shaft. In an embodiment, rotation of the main shaft and cable dispensing from the respective reels are controlled by a main controller. In an embodiment, the method of producing stranded cables includes controlling each of the plurality of cradles with a main controller; and communicating control information to each of the plurality of cradles over a wireless network. In an embodiment, in the rigid mode the plurality of cradles are pinned to a disk disposed on the main shaft. In an embodiment, in the planetary mode a plurality of gears translate rotation of the main shaft to the plurality of cradles. In an embodiment, a second strander is aligned in tandem with the first strander. In an embodiment, a stranded cable dispensed from the first strander is a core about which second cables in the second strander are stranded. In an embodiment, tension of the first cables and tension of the second cables are independently controlled. In an embodiment, the stranded cable dispensed from the first strander is supplied to a hollow center of a main shaft of the second strander. In an embodiment, the first strander and the second strander are independently operated in the rigid mode or the planetary mode.

In another aspect of the present disclosure, a method of controlling a stranding system includes rotating a strander, dispensing cables from a plurality of reels, and synchronizing the cable dispensing and the strander rotation with a controller. Further in accordance with this method, the rotating is implemented by a first motor, the cable dispensing is implemented by a plurality of motors, and the first motor and the plurality of motors communicate with the controller over a wireless network. In an embodiment, at least one feedback sensor supplies information to the controller for operating the first motor and the plurality of motors. In an embodiment, the first motor and the plurality of motors are in wired communication with a respective cradle controller. In an embodiment, the respective cradle controller is wirelessly controlled by the controller. In an embodiment, the method of controlling a stranding system includes: rotating a second strander, and synchronizing the cable dispensing and the strander motion of both stranders.

The present disclosure contemplates a method of controlling tension on a cable within a strander system, the method including configuring a dancer assembly and a loadcell along a cradle for dispensing cable, operatively coupling the dispensed cable to a dancer motor, passing the cable over one or more pulleys of the dancer assembly, passing the cable over one or more pulleys of the loadcell, sensing cable tension with the loadcell, and adjusting the dancer motor according to the sensed cable tension. In an embodiment, the dancer assembly includes at least first and second pulleys. In an embodiment, the method of controlling cable tension includes passing the cable over the one or more pulleys fewer times when more tension is desired and more times when less tension is desired. In an embodiment, the method of controlling cable tension includes controlling the dancer motor and the loadcell with one or more controllers. In an embodiment, at least one of the one or more controllers includes a wireless module. In an embodiment, the method of controlling cable tension includes providing control signals over a wireless network with at least one of the one or more controllers. In an embodiment, the method of controlling cable tension includes: sensing a tension supplied by a capstan; and adjusting the dancer motor to match the tension supplied by the capstan. In an embodiment, a controller takes as inputs sensed information from the capstan and the loadcell, and controls the dancer motor in response to the inputs. In an embodiment, the strander system includes a first strander including: a first main shaft; at least one first cradle disposed along the first main shaft, each first cradle includes: at least first one reel; at least one first dancer assembly; and at least one first wireless module, wherein the at least one first wireless module is associated with at least one of the first cradle, first reel, and first dancer assembly; and at least one first controller; wherein the first controller communicates with the at least one first cradle, the at least one first reel, or the at least one first dancer assembly with the associated at least one first wireless module. In an embodiment, the method of controlling cable tension includes a second strander disposed in-line with the first strander such that the first strander produces a stranded cable that is used as a core about which the second strander dispenses cables. In an embodiment, the second strander includes: a second main shaft; at least one second cradle disposed along the second main shaft, each second cradle includes: at least one second reel; at least one second dancer assembly; and at least one second wireless module, wherein the at least one second wireless module is associated with at least one of the second cradle, second reel, and second dancer assembly; and at least one second controller; wherein the second controller communicates with the at least second cradle, the at least one second reel, or the at least one second dancer assembly with the associated at least one second wireless module. In an embodiment, the method of controlling cable tension includes a main controller that independently communicates with the first controller and the second controller. In an embodiment, dancer motors in the first strander and second strander are independently adjusted according to sensed cable tension in each of the first strander and the second strander.

Other aspects and advantages of the present disclosure will become apparent upon consideration of the following detailed description and the attached drawings wherein like numerals designate like structures throughout the specification.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Still further, modules and processes depicted may be combined, in whole or in part, and/or divided, into one or more different parts, as applicable to fit particular implementations without departing from the scope of the present disclosure. Accordingly, the drawings and description are to be regarded as illustrative in nature and not restrictive.

Figure 1:
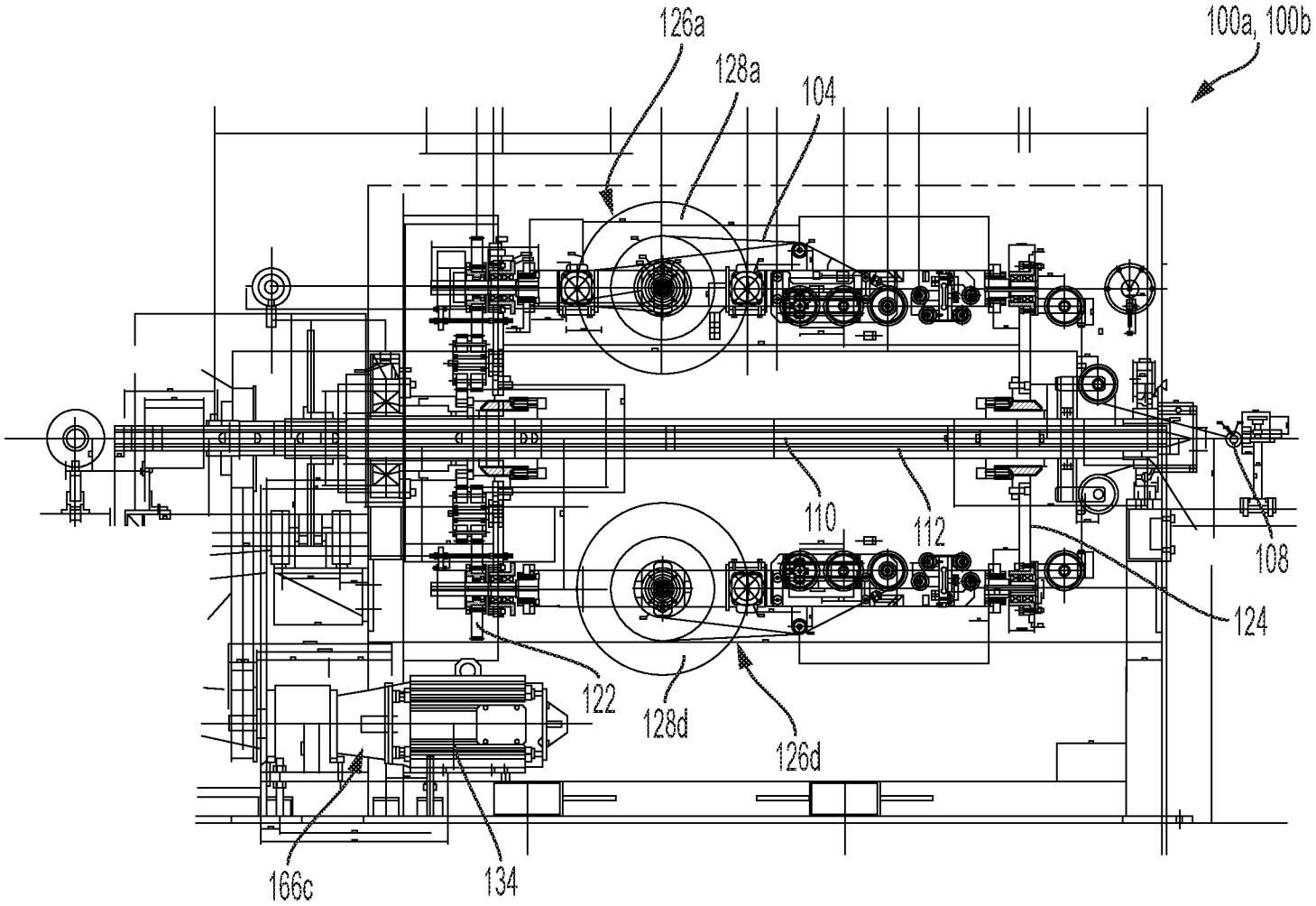
FIG. 1 is a schematic, elevational view of a strander depicting upper and lower cradles and omitting cradles disposed along sides of the strander.
Figure 2:
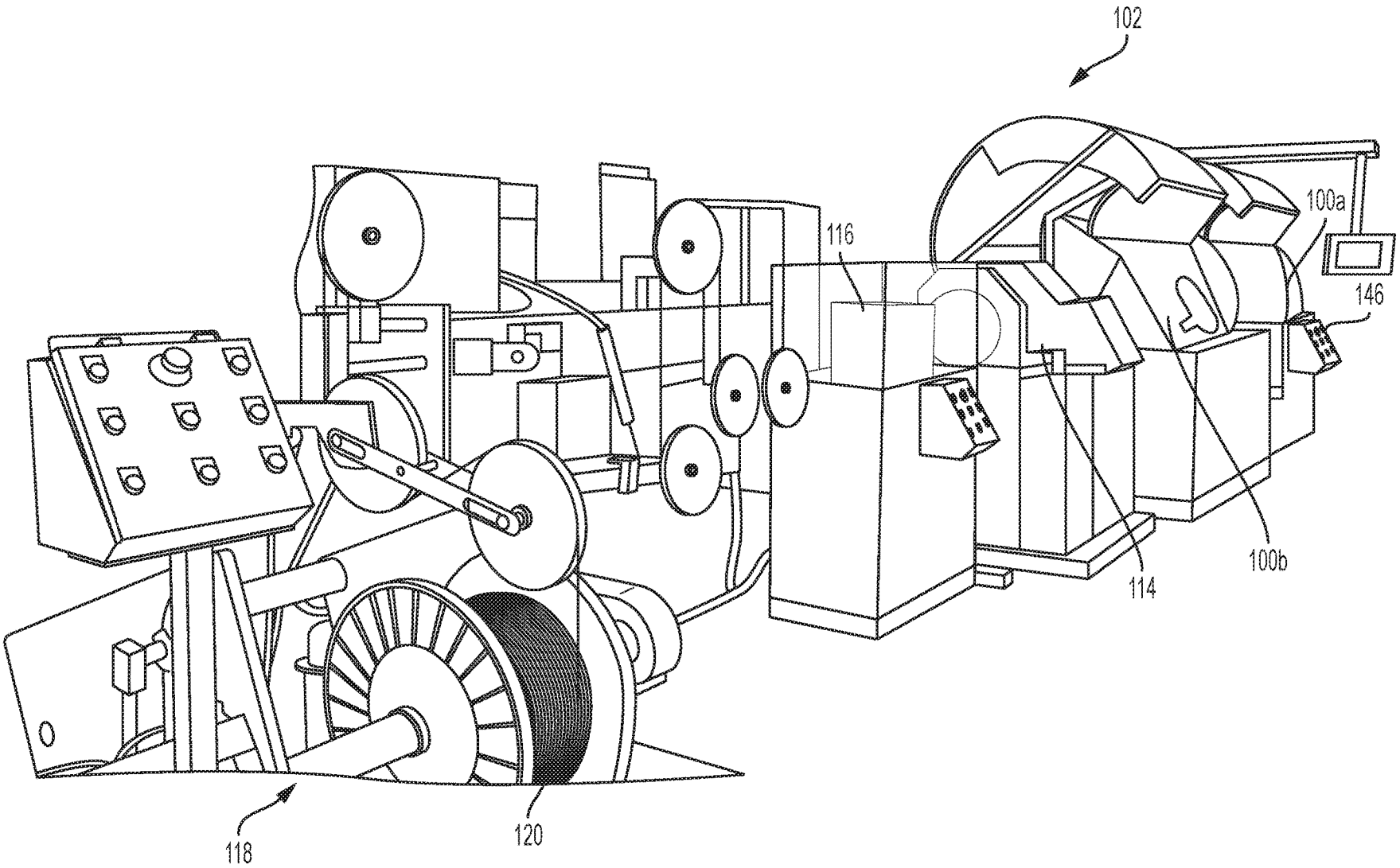
FIG. 2 is an isometric side view of a stranding system including two in-line implementations of the strander of FIG. 1.

Referring to FIG. 1, a six-position strander 100*a*, 100*b* is depicted with upper and lower cradles shown in detail and omitting cradles disposed along sides of the six-position strander. FIG. 2 depicts a stranding system 102 for fabricating stranded cable 108 according to some embodiments. The stranding system 102 comprises first and second six-position stranders 100*a*, 100*b* arranged in-line in some embodiments, i.e., as in the example shown in FIG. 2 in which a first six-position strander 100*a* is disposed in front of a second six-position strander 100*b*. In various examples described herein, a single six-position strander 100*a*, 100*b* can be referred to as strander 100*a*, strander 100*b*, or, for simplicity, strander 100. Each six-position strander 100 is designed to strand cables 104 or subunits of previously stranded cable around a core 106 (see FIGS. 3A and 3B, which depicts an example of stranded cable, although stranded cable comprising more or fewer subunits/cables is contemplated hereinthroughout). In some embodiments, the core 106 may be omitted and the cables/subunits 104 may be stranded about one another. In this disclosure, the cables 104 may refer to fibers, cables, metal, wires, glass, plastic, etc. Further examples of the cables 104 contemplated herein include copper wire, fiber optic cables, and/or insulated cords.

Referring again to FIG. 2, the two six-position stranders (bays) 100*a*, 100*b*, are positioned in tandem, one after the other, in some embodiments, as noted hereinabove. The first six-position strander 100*a* may strand up to six cables 104 about one another or about the core 106 to produce the stranded cable 108. Then, the stranded cable 108 may be supplied into a hollow center 110 of a main shaft 112 (see FIG. 1) of the second six-position strander 100*b*. The axial main shaft 112 has an inside diameter large enough to accommodate one or more guide tubes mounted therein. As a component of the stranding system 102, the guide tubes may guide stranded cable 108 produced by the first strander 100*a* through the second strander 100*b* for use as the core 106 about which the one or more cables/subunits 104 are stranded by the second six-position strander 100*b*. In this configuration, first and second stranders are disposed in-line with one another such that the first strander produces a stranded cable that is used as a core about which the second strander dispenses the cables. The second six-position strander 100*b* then may strand up to six further cables 104 about the already stranded cable 108 supplied by the first six-position strander 100*a*. The stranded cable 108 output by the stranding system 102 may comprise twelve cables 104 wrapped about one another in two layers. Once the stranded cable 108 is fabricated by the stranding system 102, the stranded cable 108 may be bound, wrapped, and/or taped by a taper 114. For example, the taper 114 may wrap a metallic tape around the stranded cable 108 to protect same during use.

FIG. 2 also depicts a caterpillar capstan 116. The caterpillar capstan 116 pulls the stranded cable 108 through the first and second six-position stranders 100*a*, 100*b*, thereby controlling the line speed of the stranders 100*a*, 100*b*. In some embodiments, the caterpillar capstan is a 24-inch, belt-type caterpillar capstan. An example advantage of the tandem, in-line six-position stranders 100*a*, 100*b* is that this configuration provides for increased line speed as compared with a twelve-position strander. When a start command is issued to the stranding system 102 and/or the strander 100, the cables/subunits 104 are accelerated via the caterpillar capstan puller 116. The stranders 100*a*, 100*b* and/or other components (such as reels/pay-offs) may use the caterpillar capstan 116 as a speed reference. The caterpillar capstan 116 may include a speed feedback sensor for this purpose.

The caterpillar capstan 116 and/or the associated speed feedback sensor may assist in applying a stop or ramp-down command to the stranding system 102. In some embodiments, as the stranded cable 108 reaches a desired length, the caterpillar capstan 116 may ramp down the speed of the stranding system 102 such that production stops within approximately five feet of the desired stranded cable length 108. The caterpillar capstan 116 may include a pneumatic open/close system to apply gentle pressure on the stranded cable 108 dispensed by the strander 100 and/or the stranding system 102.

Figure 8:
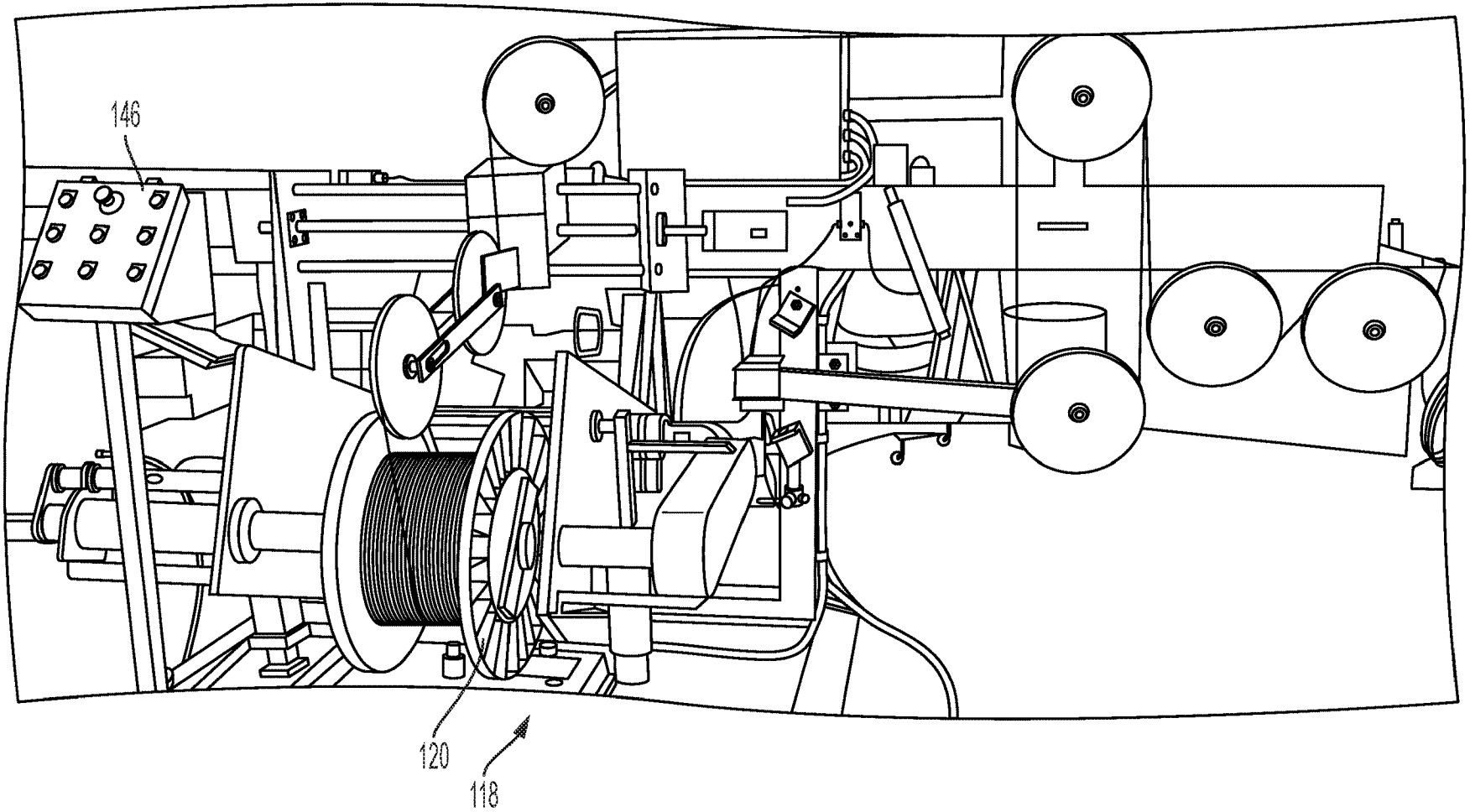
FIG. 8 is an enlarged image of a take-up segment of the stranding system of FIG. 2.

In some embodiments, a main controller 148 (see FIGS. 6 and 14), such as a programmable logic controller (PLC) may control the caterpillar capstan 116, such as by controlling the pneumatically applied pressure supplied by the capstan 116. The desired pressure set-point for the caterpillar capstan 116 is entered through a human machine interface, such as a control panel, associated with the main PLC 148. The caterpillar capstan winds the stranded cable 108 fabricated by the stranding system 102. Upper and lower capstan belts ride on multiple grooved pulleys such that force/pressure is evenly applied along the belts to pull and wind the stranded cable 108. According to some embodiments, tensioning of the belts is controlled mechanically by threaded rods that tighten the belts. The caterpillar capstan belts may be driven by a transfer case and a single, shared AC vector motor. Alternatively, the caterpillar capstan belts may be driven by one or more suitable motors, such as a DC motor, hydraulic motor, and/or pneumatic motor. Also, a take-up 118 (see FIG. 8) is depicted as following the two tandem six-position stranders 100*a*, 100*b*. At the take-up 118, a final product of taped/wrapped 12-strand stranded cable 108 is gathered by a reel 120.

Figure 4:
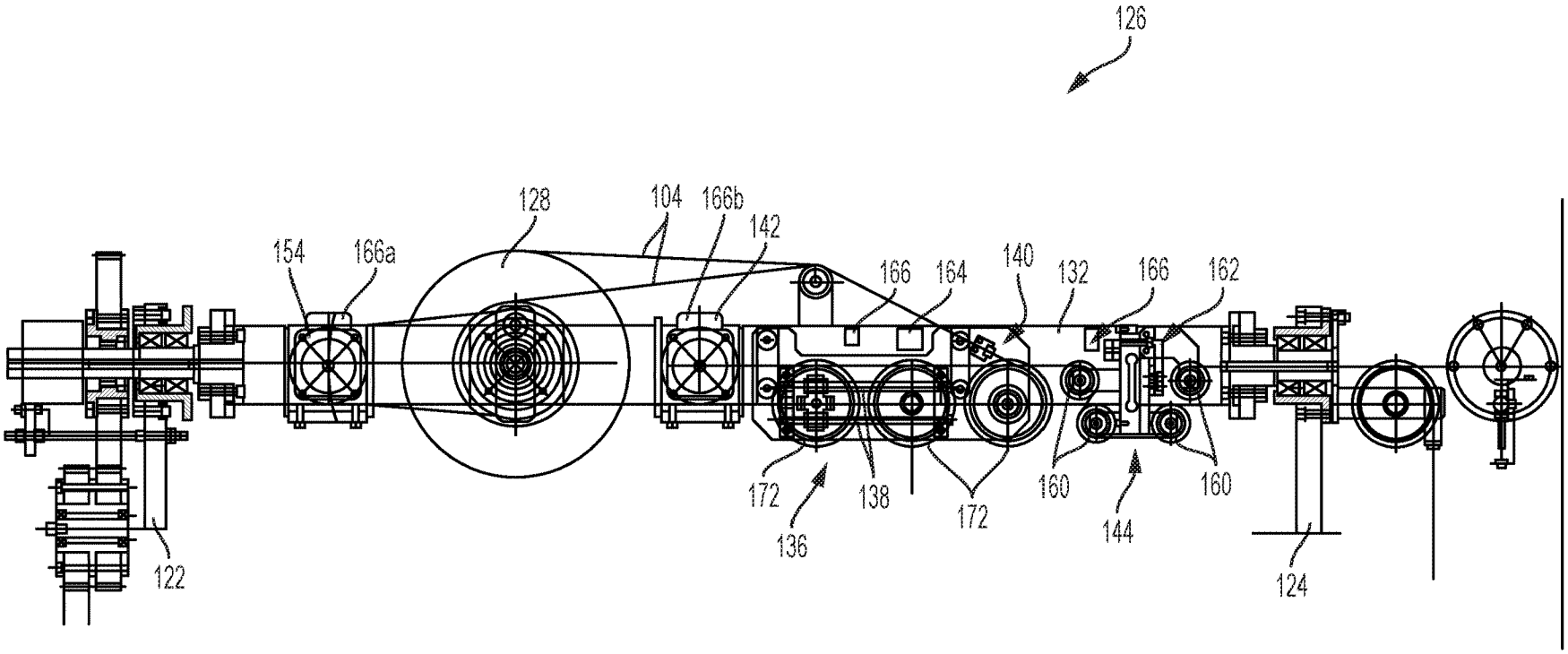
FIG. 4 is a schematic, elevational view of the upper cradle of the strander of FIG. 1.
Figure 5:
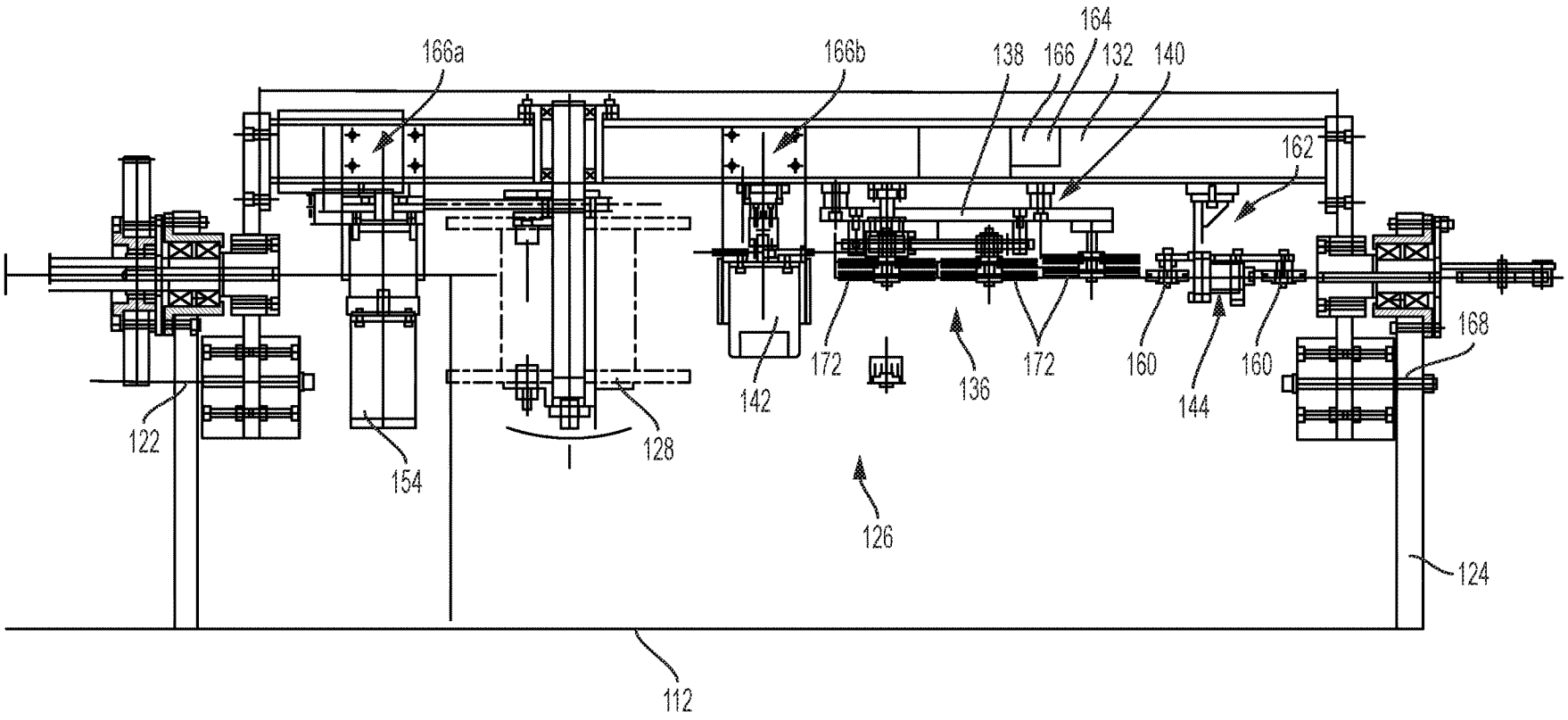
FIG. 5 is a schematic, plan view of the cradle of FIG. 4.
Figure 6:
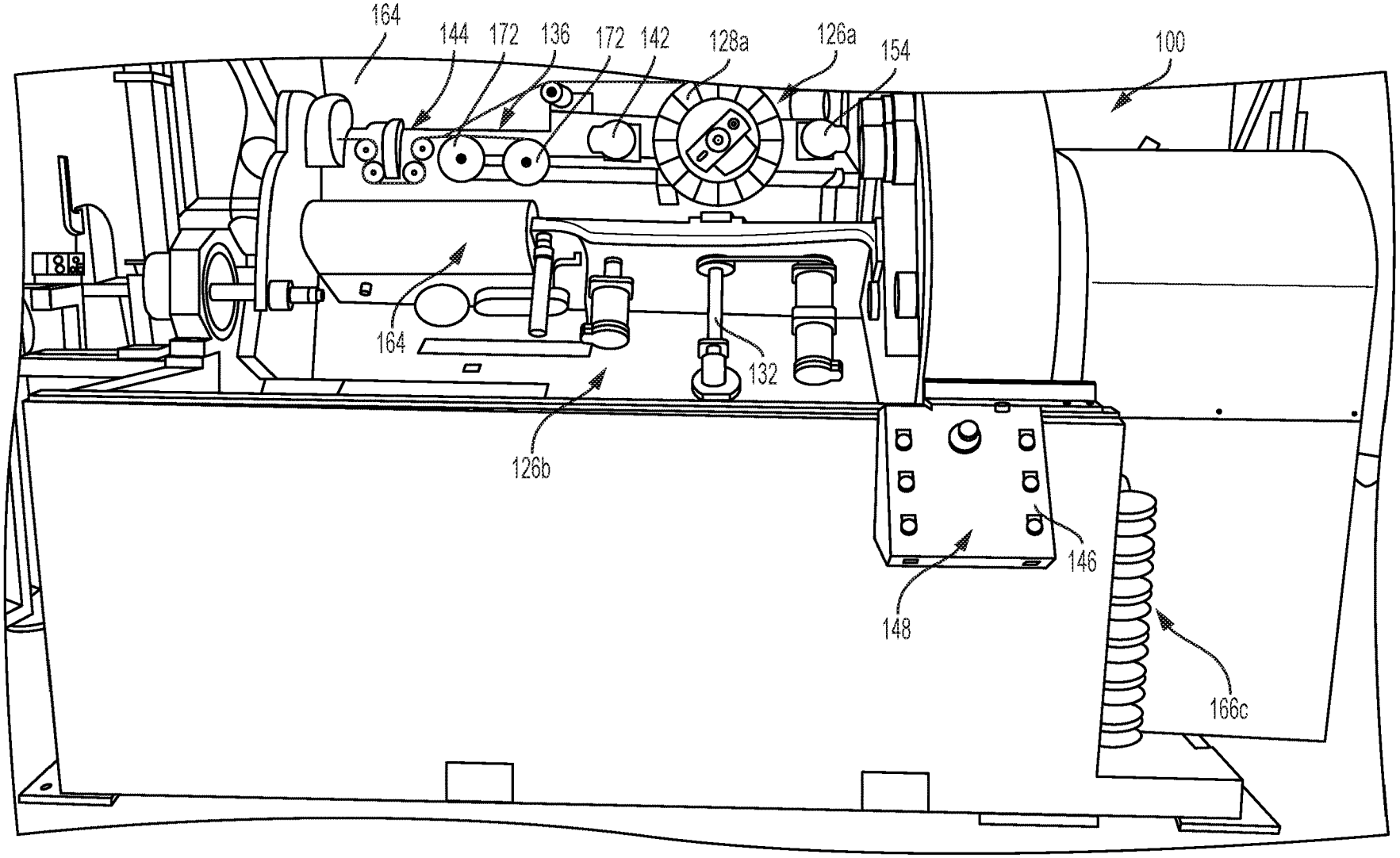
FIG. 6 is an image of the strander of FIG. 1 with a housing thereof opened such that at least the upper cradle is visible.
Figure 7:
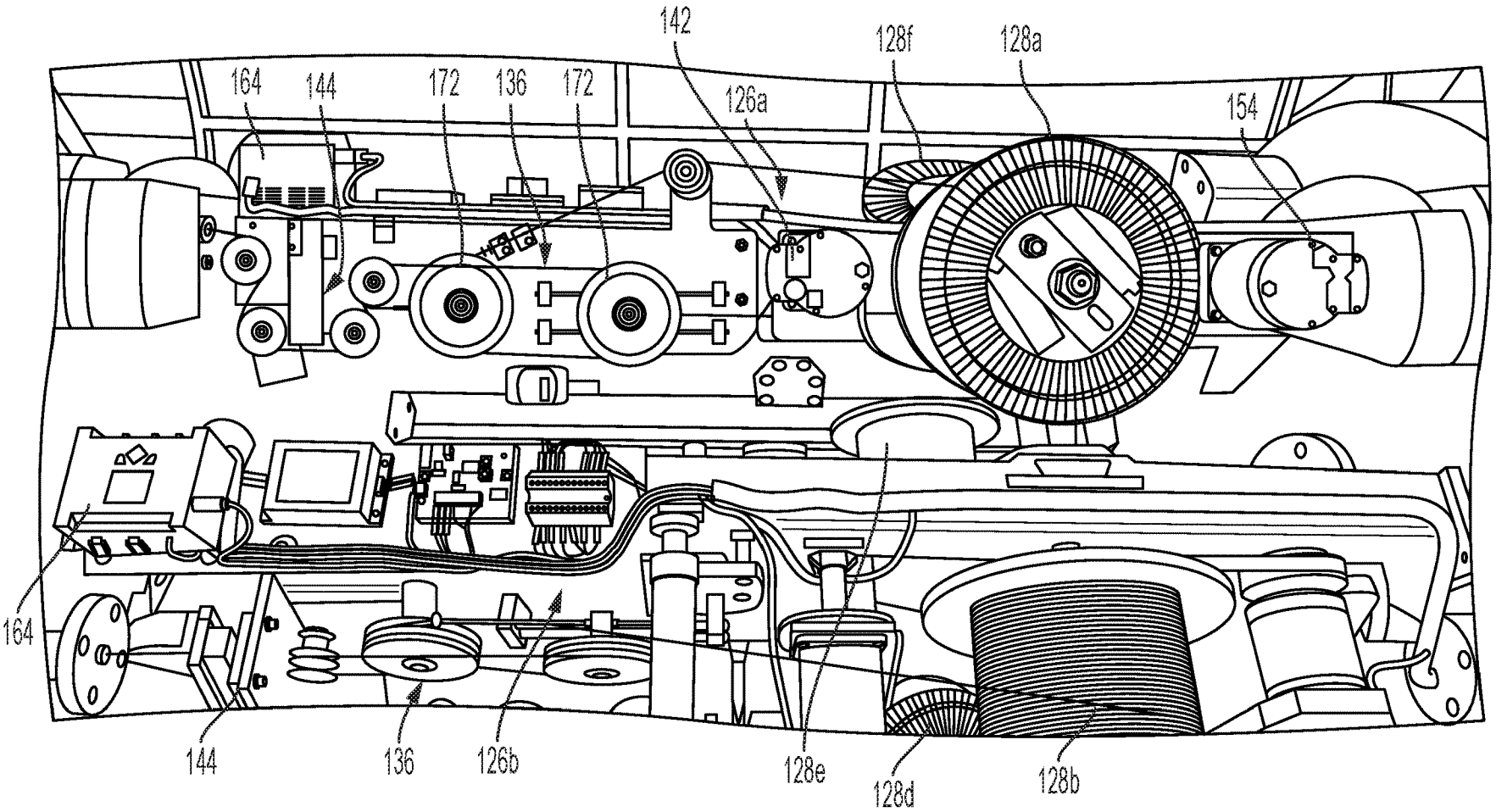
FIG. 7 is an enlarged image of the strander shown in FIG. 6.
Figure 9:
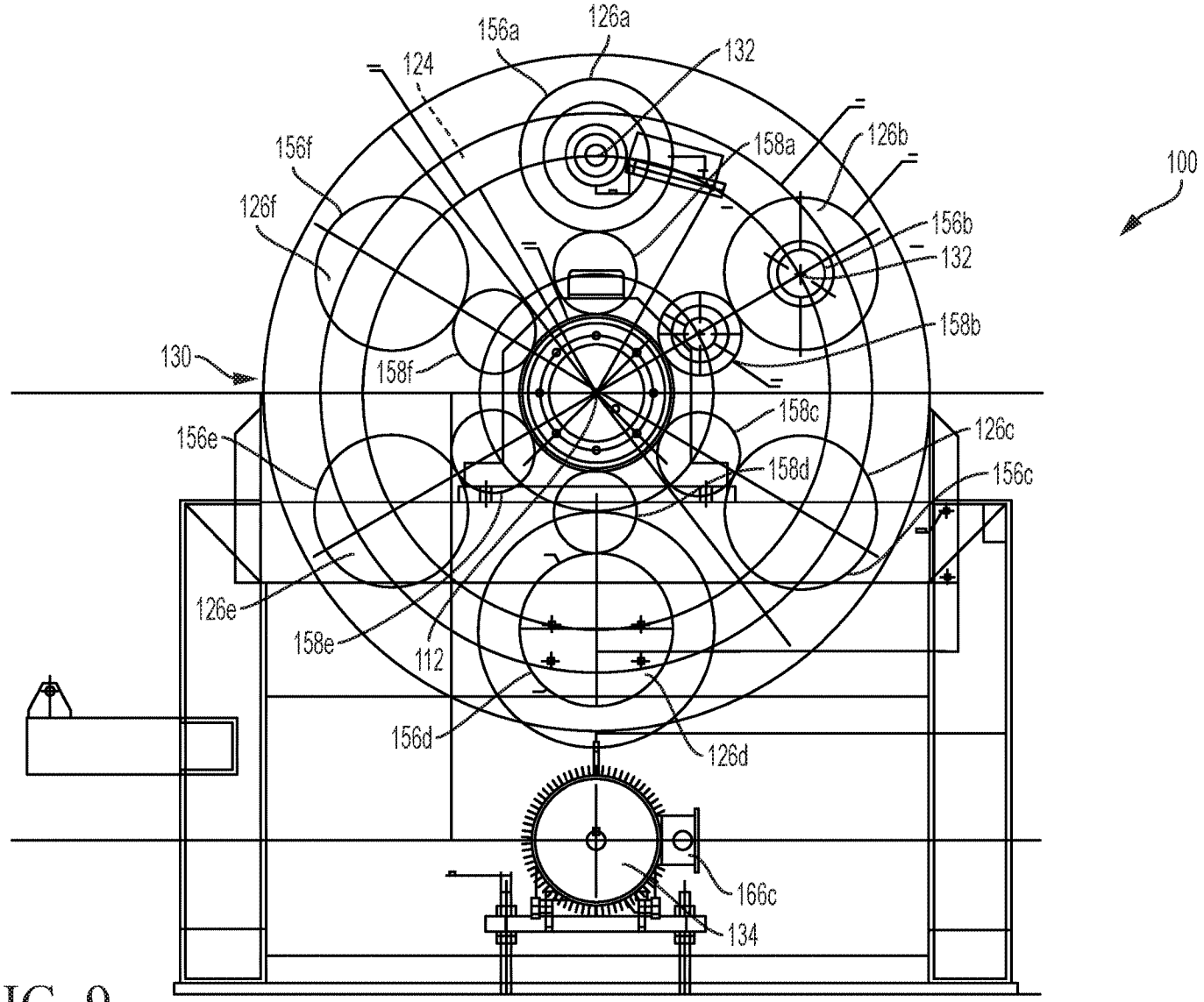
FIG. 9 is a schematic, elevational end view of the strander of FIG. 1 depicting cradle positions.
Figure 10:
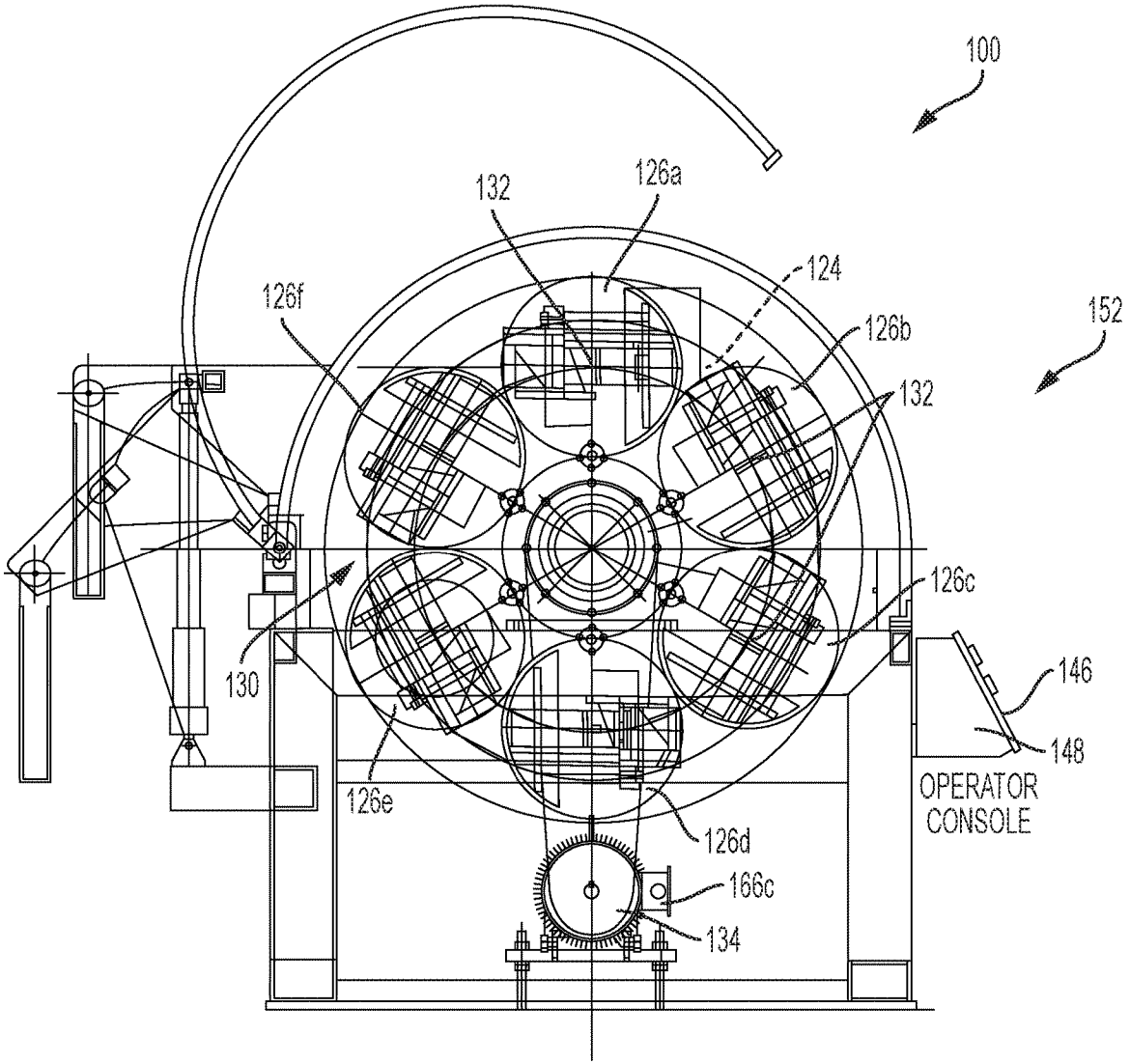
FIG. 10 is a schematic, elevational end view of the strander of FIG. 1 with the cradles depicted according to a rigid mode configuration.
Figure 11:
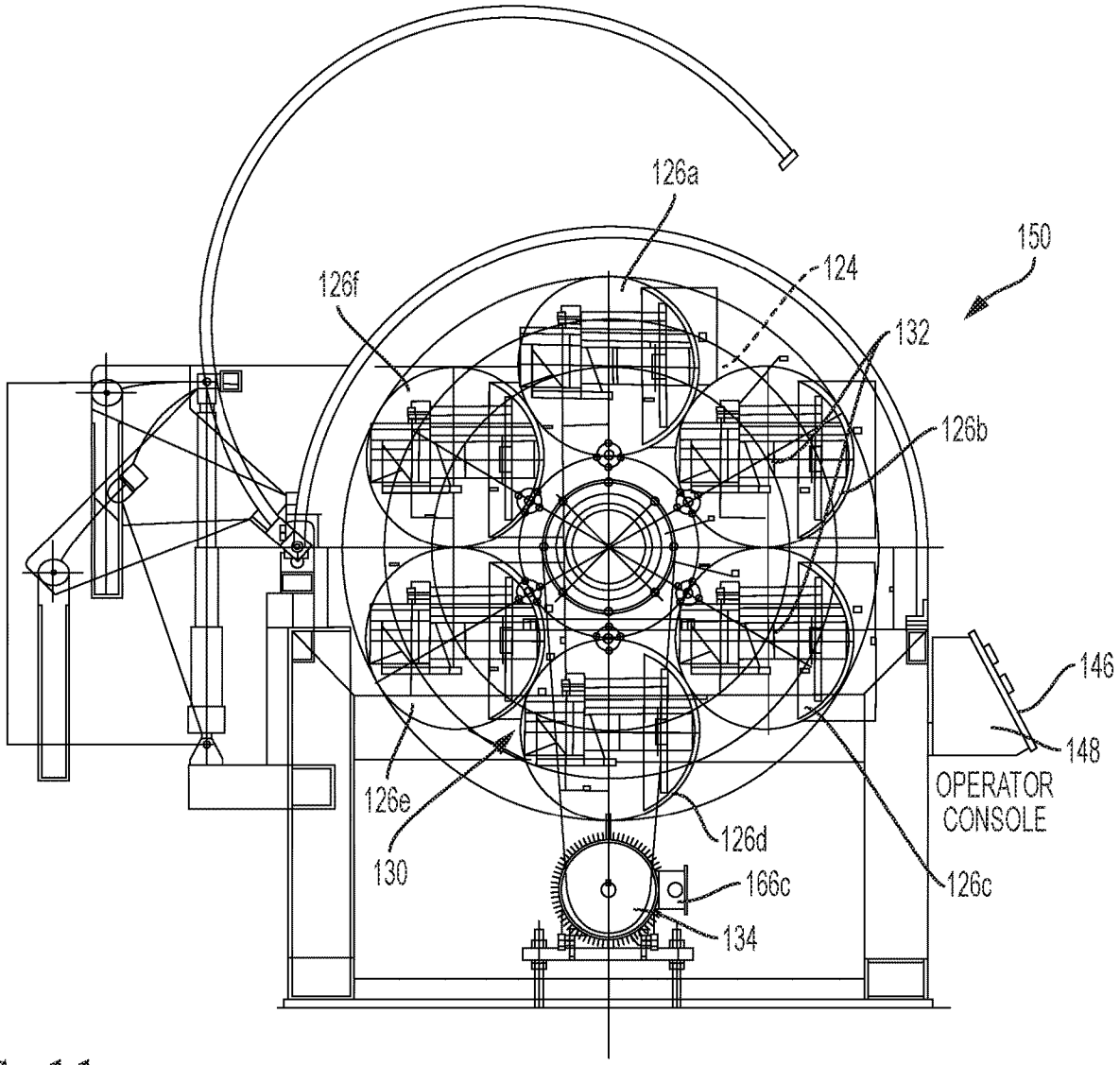
FIG. 11 is a schematic, elevational end view of the strander of FIG. 1 with the cradles depicted according to a planetary mode configuration.

In some embodiments, the stranders 100*a*, 100*b* are substantially identical to each other, other than the relative locations thereof, and so, for the purpose of clarity, the construction and operation of one exemplary six-position strander 100 is described hereinbelow with reference to FIGS. 4-13. As shown in FIGS. 4-6, the strander 100 comprises two disks 122, 124 mounted on the tubular main shaft or lumen 112 (FIG. 1). First through sixth cradles 126 (126*a*-126*f*), each holding a respective reel 128 (128*a*-128*f*) of cable 104, are mounted between the first and second disks 122, 124. The hollow, tubular main shaft 112 allows cables/stranded cable to pass through the center of the strander 100, as noted hereinabove with respect to the arrangement of the stranding system 102. In some embodiments, the main shaft 112 and attached disks are driven by an AC vector motor and/or another suitable motor. Strander embodiments may have a different number of cradles 126, and, therefore, different numbers of respective stranding positions. For example, four to twelve cradles/positions may be desirable for some strander embodiments. Referring ahead to FIGS. 9, 10, and 11, end views of the strander 100 depict arrangements of the six cradles 126*a*-126*f*. The cradles 126*a*-126*f* are driven by a planetary gear arrangement 130 so that the movements thereof, and the movements of each reel 128*a*-128*f* disposed thereon, are synchronized.

Referring now to FIGS. 4-7, because the cradles 126*a*-126*f* are substantially identical other than the relative location thereof, a single cradle 126 is described in detail hereinbelow. The reel/pay-off 128 is secured on a cradle shaft 132 and the cradles 126*a*-126*f*, by way of the respective cradle shafts 132, are driven by a cradle motor 134 (see FIGS. 9, 10, and 11). The cradle motor 134 may be an electric servo, a pneumatic or hydraulic actuator, and/or another suitable motor. The reel/pay-off 128 of each of the cradles 126 has customizable, settable positioning. Particular tension (of the cables/subunits traversing through the strander 100) setpoints are associated with the positioning of the reel 128. As noted hereinabove, the strander 100 has first and second disks 122, 124 mounted on the hollow, axial main shaft 112. The main shaft 112 and disks 122, 124 are driven by the cradle motor 134.

Each of the cradles 126 may further include a reel motor 154 such as an AC vector motor and/or another suitable motor. The six cable elements/subunits 104 are dispensed by the reels 128 mounted on the six cradles 126*a*-126*f* that are aligned between the two disks 122, 124. For each of the cradles 126, the reel motor(s) 154 operate the reels 126 to dispense the cable/subunit disposed thereon. The reel motor 154 may be synchronized with the caterpillar capstan 116 and/or additional components of the respective cradle 126 and strander 100.

A dual loop dancer assembly 136 is mounted on slide rails 138 to provide tension on the cable/subunit 104 traversing the cradle 126. The rails 138 are oriented in an axial direction along the cradle 126 parallel to the cradle shaft 132. This configuration of the dancer rails 138 may decrease the effect of centrifugal force on the dancer arrangement 136. In some embodiments, the dancer 136 has associated feedback sensors 140 in operative communication with a dancer motor 142. The feedback sensors 140 may provide information and/or alarms to the dancer motor 142 to maintain/control cable tension and/or in case of a cable break. The dancer assembly 136 is described further hereinbelow with reference to FIGS. 12 and 13.

A loadcell assembly 144 is disposed between the dual loop dancer 136 and the exiting end of the strander 100. The loadcell assembly 144 may include a plurality of rollers 160. The loadcell assembly 144 measures tension on the cables/subunits 104. Feedback provided by one or more feedback sensors 162 disposed amongst the loadcell assembly 144 may be used in conjunction with the feedback sensors 140 of the dual loop dancer assembly 136 to maintain the desired tension on the cables/subunits 104. The loadcell transmitter/feedback sensors 162 may be calibrated to output a 0-10V signal mapped over a span of 250 to 5000 grams.

Further, each cradle 126*a*-126*f* includes a controller 164, such as a programmable logic control (PLC) or another suitable electronic controller. Additionally, each cradle 126*a*-126*f* includes one or more wireless modules 166 (see also FIG. 14). In some embodiments, the reel motor 154, the dancer motor 142, and the cradle motor 134 may be operatively connected with associated wireless modules 166*a*, 166*b*, 166*c* of the one or more wireless modules 166. The one or more wireless modules 166 are in communication with the cradle controller 164 associated therewith by way of a wireless network 170 (see FIG. 14).

Figure 15:
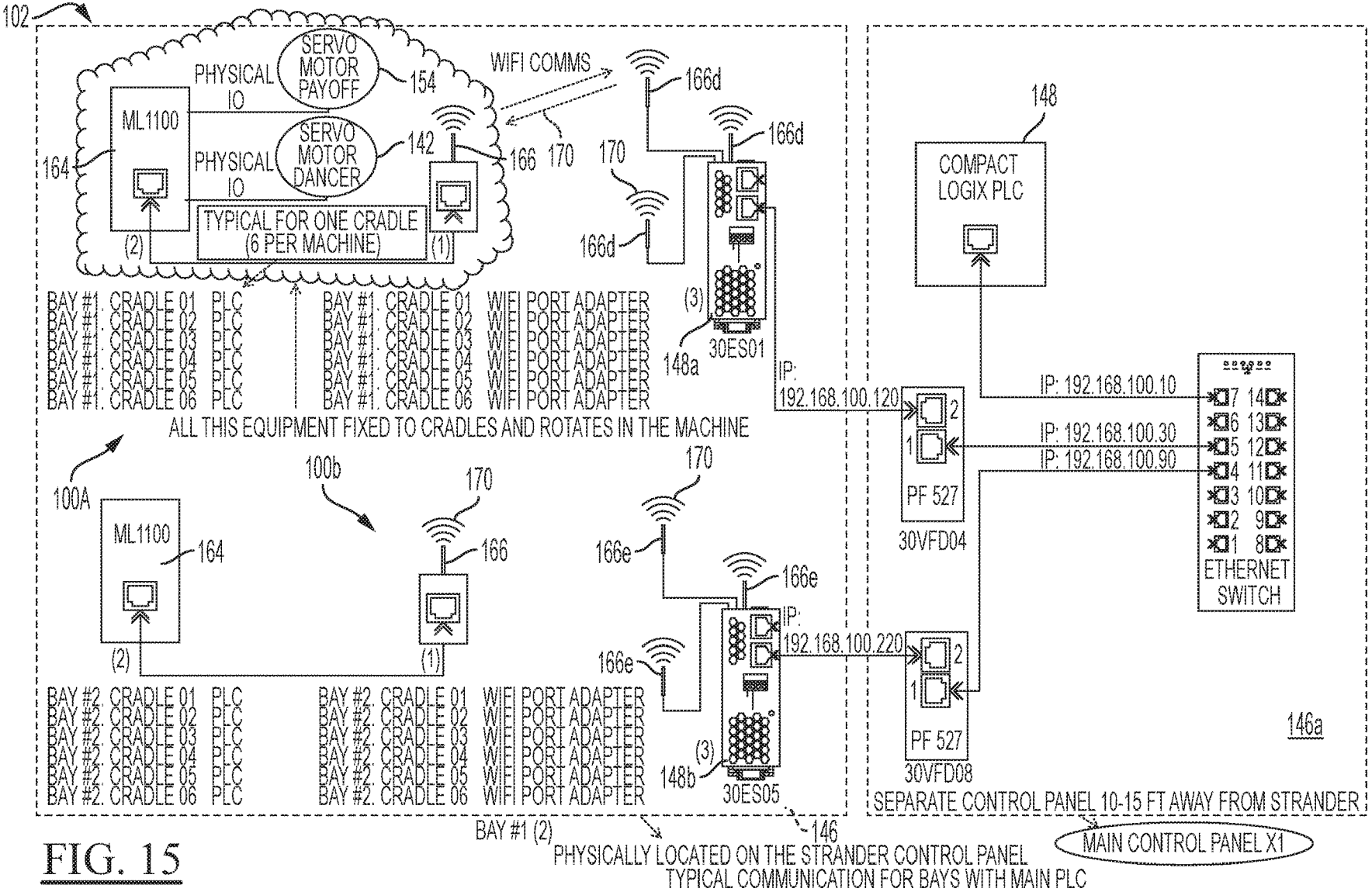
FIG. 15 is a schematic diagram depicting communications between a main PLC and an exemplary strander of the stranding system.

Further, the one or more wireless modules 166 may be communicatively coupled to the main PLC 148, directly, or by way of the cradle controller(s) 164, again, over the wireless network 170. Both the reel motor 154 and dancer motor 142 may be driven by servomotors with integrated drives. Further, each of the cradle controllers/PLC s 164 communicates with main PLC 148 through one of the one or more wireless modules 166, such as a wireless Ethernet bridge, Wi-Fi, a Bluetooth™ connection, and/or another suitable wireless connection. In some examples, such as that shown in FIG. 15, the main PLC 148 is disposed in the main control panel 146*a* remote from the first and second stranders 100*a*, 100*b*. The main PLC 148 communicates through a wired connection with first and second strander bay controllers 148*a*, 148*b* associated with the first and second stranders 100*a*, 100*b*, respectively. Each of the strander bay controllers 148*a*, 148*b* have first and second pluralities of wireless modules 166*d*, 166*e* associated therewith. The strander bay controllers 148*a*, 148*b* communicate control signals from the main PLC 148 to the cradle controllers 164 over the wireless network 170. In this example, each of the stranders 100*a*, 100*b* have six cradle controllers that further have six of the wireless modules 166 associated therewith. Each of the cradle controllers 164 have wired connections traversing along the corresponding cradles 126 to the reel motor(s) 154 and the dancer motor(s) 142 disposed respectively thereon. Accordingly, the main PLC 148 controls and coordinates the operations of all twelve of the cradles 126 by way of the wireless network 170, thereby wirelessly controlling the stranding system 102.

Figure 14:
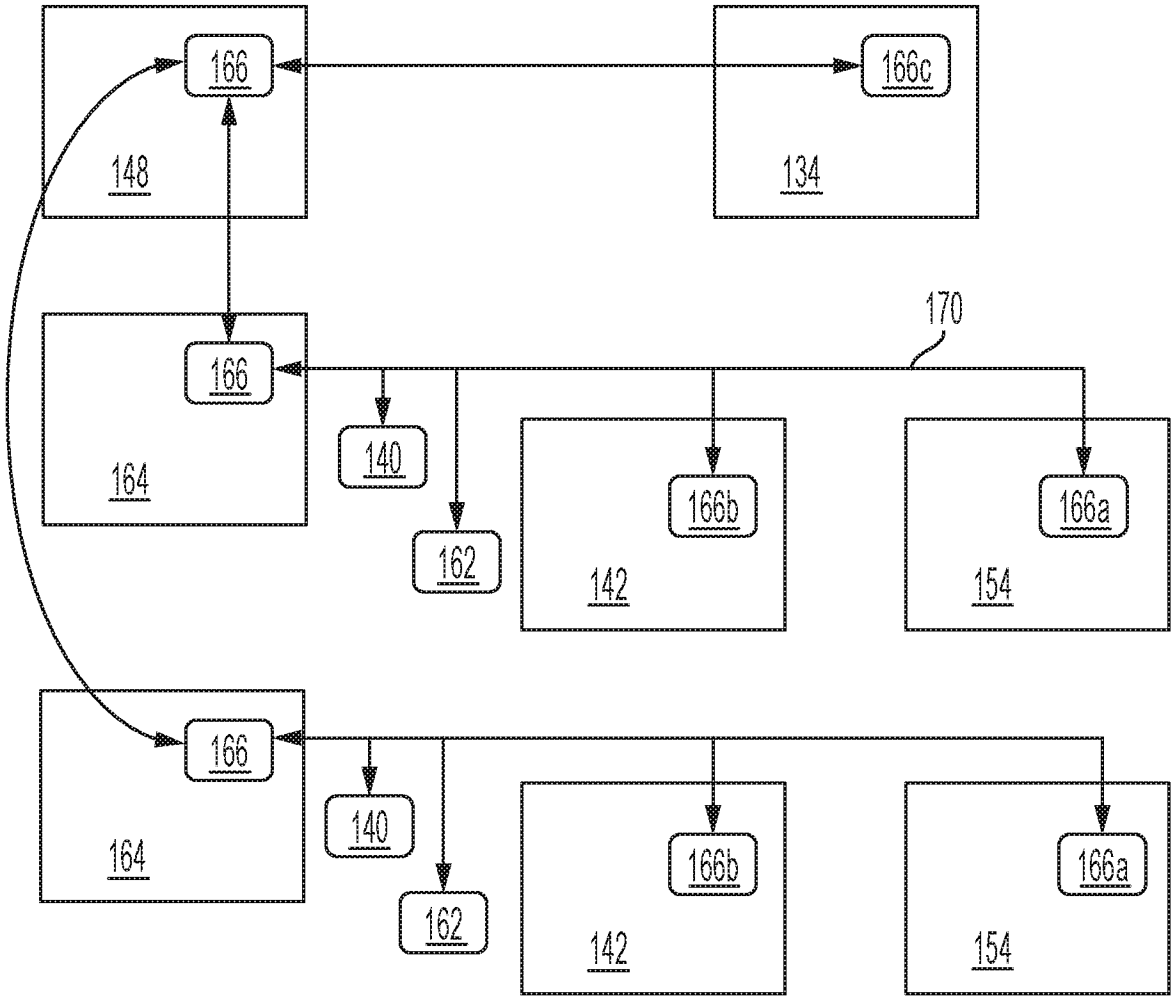
FIG. 14 is a block diagram depicting a control system for the strander of FIG. 1.

The introduction of wireless communication between the main PLC 148 and the cradles results in an overall less cumbersome strander having relatively less wiring. Further, wireless communications between the cradle controllers/PLCs 164 and the components of each of the cradles 126*a*-126*f* allows for unobstructed rotation thereof as compared with numerous slip rings, which may otherwise surround components of the strander 100, including individual cradles, to facilitate communications. The wireless modules 166 may increase the ease with which the motors 134, 142, 154 are synchronized thereby supporting more expedient and reliable control of the strander 100. Further, the wireless communications may provide for a more compact strander design and allow for more precise control over tension of the cables/subunits 104 as the same traverse the stranding system 102. FIG. 14 illustrates with a block diagram communications between and amongst the cradle controllers/PLCs 164, the main controller/PLC 148, and the wireless modules 166. In some embodiments, the main controller/PLC 148 may be shared by first and second stranders 100*a*, 100*b*. Also in some example embodiments of the stranding system 102, the main controller/PLC 148 of the first and second stranders 100*a*, 100*b* may communicate with one another over the wireless network 170.

Figure 3A:
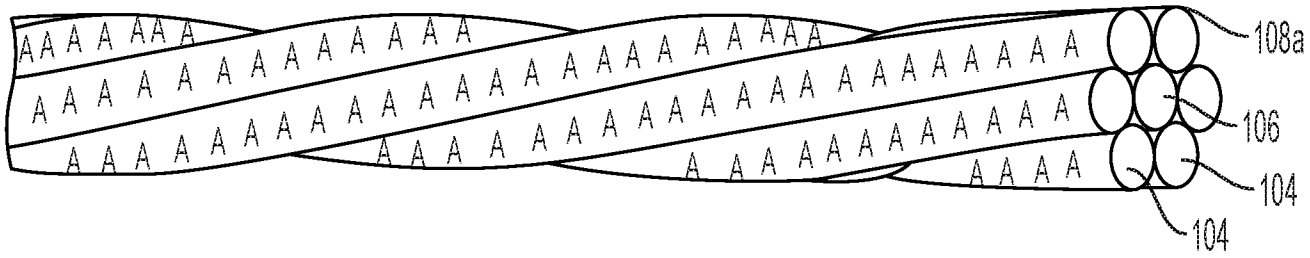
FIG. 3A is an isometric side view of an end of a strand produced by the strander of FIG. 1 in a planetary mode.
Figure 3B:
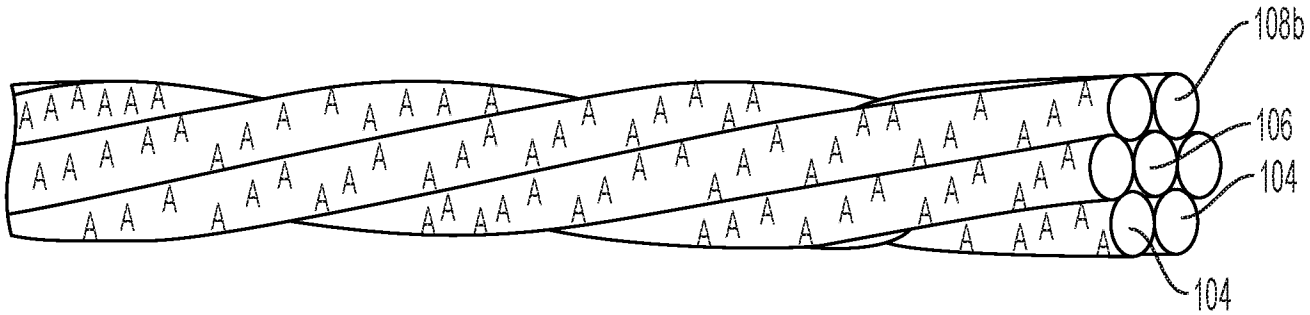
FIG. 3B is an isometric side view of an end of a strand produced by the strander of FIG. 1 in a rigid mode.

The strander 100 may operate in one or more modes including a planetary mode 150 and a rigid mode 152. The six-position strander 100 is designed to planetary or rigid strand cable elements or subunits 104 from the reels 128*a*-128*f* of the cradles 126*a*-126*f*. FIG. 3A depicts a stranded cable 108*a* fabricated by the strander 100 in the planetary mode 150. Printing on one side of each of the subunits 104 remains directed outward as the subunits 104 are not twisted during stranding of the stranded cable 108*a*. FIG. 3B depicts a stranded cable 108*b* fabricated from the strander 100 in the rigid mode 152. Printing on one side of each of the subunits 104 reflects the twisting of the subunits 104 as same are stranded to form the stranded cable 108*b*.

The strander 100 may be designed to keep the cradles 126*a*-126*f* relatively close to the main shaft 112, thereby disposing the cradles 126*a*-126*f* near a center of rotation. FIG. 11 illustrates an end view of the planetary gear arrangement 130 in planetary mode 150 at the entrance of the strander 100. The second disk 124 is shown as transparent in FIGS. 9, 10, and 11. In the planetary mode 150, the planetary gear arrangement 130 turns each of the cradles 126*a*-126*f* about the respective cradle shaft 132 thereof in synchronization with the rotation of the cradles 126*a*-126*f* about the main shaft 112. Therefore, the cradles 126*a*-126*f* rotate axially with respect to the main shaft 112 in addition to rotating about the main shaft 112. Accordingly, the cradles 126*a*-126*f* maintain a same orientation with respect to a given plane, such as the floor. For example, as shown in FIG. 11, the cradles 126*a*-126*f* may be maintained in a common orientation in which the reels 128 mounted therein would have a reel axis that is parallel to the other reel axes and to the floor on which the strander 100 sits, even as each reel axis rises and falls (e.g., repeatedly passing through the axis of the main shaft 112) as the cradles 126-126*f* revolve around the main shaft 112.

FIG. 10 depicts the six-positon stander 100 operating in rigid mode 152. In the rigid mode 152, the cradles 126*a*-126*f* are rigidly disposed about the main shaft 112 such that one side of each of the cradles 126*a*-126*f* faces the main shaft 112 throughout operation. Further, in the rigid mode 152 each of the cradles 126*a*-126*f* do not rotate about the respective cradle shaft(s) 132 thereof. As shown in FIG. 10, in the rigid mode 152, each of the cradles 126*a*-126*f* may be oriented differently and rigidly with respect to the floor on which strander 100 sits. In the specific example of FIG. 10, the cradles 126*a*-126*f* are oriented such that reels 128 mounted therein have a reel axis that is tangentially oriented with respect to the main shaft 112 of the strander 100, and remains unchanged during stranding operations. It should also be appreciated that the specific orientations of the cradles 126*a*-126*f* depicted in FIGS. 10 and 11, for the rigid and planetary modes respectively, are merely illustrative and other orientations can be used for the respective rigid and planetary stranding operations.

Referring again to FIG. 9, the first through sixth outergears 156*a*-156*f* are depicted in positions disposed about the main shaft 112 of the strander 100. Here, the outergears 156*a*-156*f* approximate locations of the respective cradles 126*a*-126*f* to which said outergears 156*a*-156*f* are operatively coupled. Disposed between each of the outer gears 156*a*-156*f* and the main shaft 112 are associated planetary gears 158*a*-158*f*. The planetary gears 158*a*-158*f* link the main shaft 112 with the outergears 156*a*-156*f* of the cradles 126*a*-126*f*. In the planetary mode 150, the interaction of the planetary gears 158*a*-158*f* translates the rotation of the main shaft 112 to the cradles 126*a*-126*f*, thereby rotating the cradles 126*a*-126*f*, by way of the outergears 156*a*-156*f*. The planetary gears 158*a*-158*f* are held in place by one or more clip rings when the strander 100 operates according to the planetary mode 150. The clip rings are removed to release the planetary gears 158*a*-158*f* during transformation into the rigid mode 152, as discussed hereinbelow.

In the planetary mode 150, the cables/subunits 104 are not twisted about the individual axes thereof during the stranding process because the cradles 126*a*-126*f* remain in the same orientation relative the floor while travelling about the main shaft 112. Omission of the twisting motion may be desirable for stranding fiber optic cables, insulated cables, and/or other cables/subunits 104 for which twisting may have negative structural/mechanical outcomes.

In order to switch the strander 100 from the planetary mode 150 to the rigid mode 152, the planetary gears 158*a*-158*f* and the outergears 156*a*-156*f* are disengaged. The planetary gears 158*a*-158*f* can slide out from engagement with the outergears 158*a*-158*f* for each cradle 126*a*-126*f*. Then each of the cradles 126*a*-126*f* may be pinned to the second disk 124 by a pin 168, as depicted in FIG. 5. Switching between the planetary and rigid modes/configurations 150, 152 may be desirable when the reels 128 are interchanged to carry different cable/subunit materials. Specifically, the planetary mode 150 may be desirable for stranded fiber optic cable while the rigid mode 152 may be preferred for stranded copper wire. In some embodiments, one strander is operated in planetary mode, while a second in-line strander is operated in rigid mode, or vice versa.

The cables/subunits 104 are guided through rollers and ceramic eyelets towards an exiting end of the strander 100. An adjustable-position stranding die may be mounted at the exiting end of the six-position strander 100 to gather the fibers/subunits. The adjustable position stranding die may be interchangeable such that dies may be interchanged for continuous gathering of the stranded cable 108 fabricated by the strander 100. A fiber/cable clamp may also be mounted to the exiting end of the strander 100 and/or the stranding die to hold the fibers/subunits during string-up. One or more control panels 146 may be mounted on the front of the strander 100, proximal the caterpillar capstan 116, proximal the dancer assembly 136, and/or proximal the pay-off 144 for providing operator input at one or more points in the stranding system 102. For example, the one or more control panels 146 allow the operator to set parameters and download recipes to the strander 100 and/or the stranding system 102.

Figure 12:
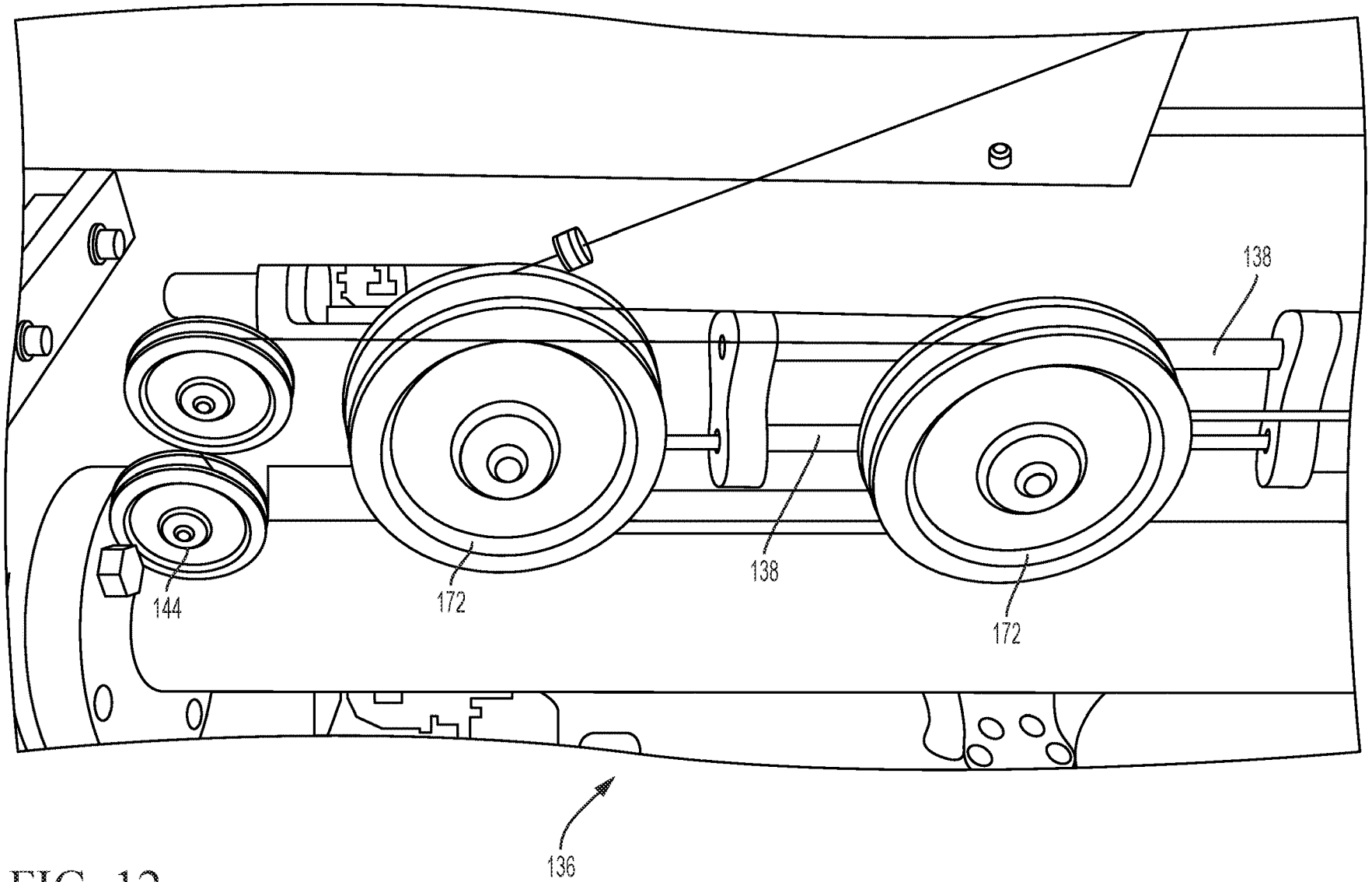
FIG. 12 is an isometric view from above of a dancer assembly, which is a component of a cradle such as that shown in FIGS. 4 and 5.
Figure 13:
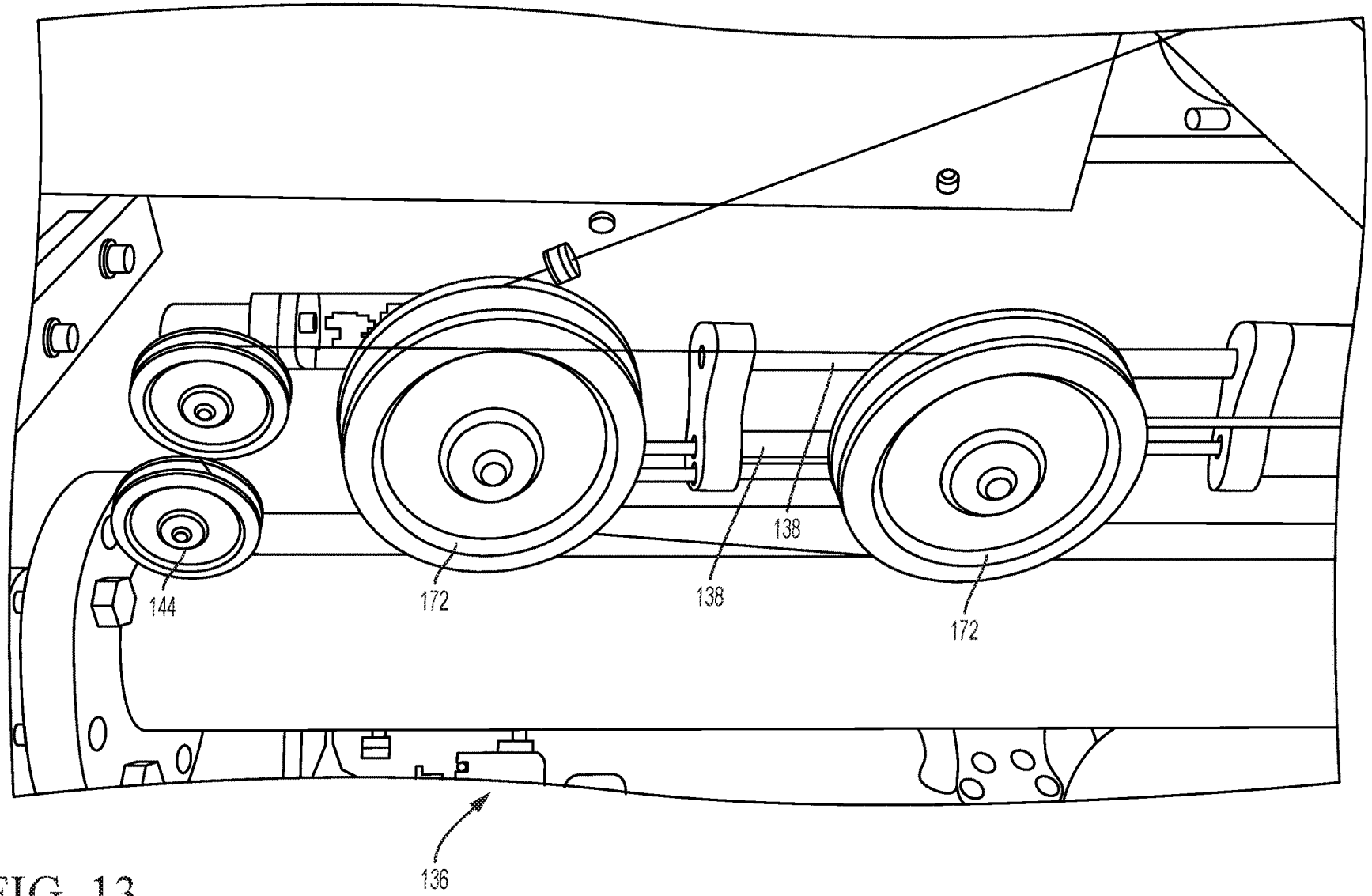
FIG. 13 is an isometric view from above of another configuration of the dancer assembly of FIG. 12.

Referring to FIGS. 12 and 13, the dancer assembly 136 maintains tension on the cables/subunits 104 traversing through the strander 100. When production specifications call for tension on the cable/subunit 104 of the unwinding reels 128 below 1000 grams the dancer assembly 136 uses two loops, i.e., the cable/subunit 104 is wound over two loops of each dancer pulley 172 (see FIG. 12). The double loop over the pulley allows the dancer motor 142 to use the mechanical advantage to smoothly deliver the decreased tension. For tension of 1000 grams or greater, the cable/subunit 104 passes over only one loop of the pulleys 172 of the dancer assembly 136 (see FIG. 13). Desired tension of the cables/subunits 104 is maintained by a combination of the looping arrangement of the dancer pulleys 172 and the position of the dancer pulleys 172. The dancer motor 142 may be wirelessly instructed by the cradle PLC 164 to manipulate angles of, or space between, the dancer pulleys 172. In accordance with feedback from the dancer sensors 140 and/or the loadcell sensors 162 the angles and relative locations of the dancer pulleys 172 are altered by the dancer motor 142 to maintain a constant tension on the cables/subunits 104. Thereby a feedback system is established between the sensors 140, 162, the cradle controller/PLC 164, and the dancer motor 142.

The embodiment(s) detailed hereinabove may be combined in full or in part, with any alternative embodiment(s) described.

INDUSTRIAL APPLICABILITY

Increasingly, manufacturers have a goal of fabricating stranded cable with more than one type of subunit in order to meet customer demands. According to the current state of the art, this goal would entail more than one strander having different gears and configurations specifically designed to operate in planetary or rigid, yarn-server modes. Construction of a machine that meets the varying goals of manufacturers represents an improvement in the art.

To solve the challenge of producing stranded cables with more than one type of cable/subunit, a strander and stranding system are disclosed herein. The strander switches between operability modes, i.e., between a planetary mode and a rigid mode. Further, to meet the manufacturing demands outlined hereinabove, the stranding system aligns at least first and second stranders in tandem. This configuration may assist in meeting the manufacturing specifications of various cable/subunit material types.

The above disclosure represents an improvement in the art because it allows for switching between rigid and planetary stranding by the same strander in some embodiments. Further, the components of the cradle(s) and strander(s) communicate wirelessly, which enables easier switching between the rigid and planetary stranding configurations in some embodiments.

Headings and subheadings, if any, are used for convenience only and are not limiting. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the disclosure (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. A strander apparatus, comprising:

a disk;

a plurality of cradles, each of the cradles comprises a reel and a cradle shaft, the cradle shaft extending in an axial direction from the disk, wherein each reel dispenses cable;

a plurality of loadcells associated with the plurality of cradles and disposed proximal to the cradle shafts;

a plurality of cradle controllers, wherein each of the plurality of cradles further comprise one or more motors controlled by the respective cradle controller of the plurality of cradle controllers;

a main shaft, wherein the cradles are disposed on the cradle shafts radially about the main shaft; and planetary gears disposed between the main shaft and respective cradle shafts, wherein the strander operates in one of a planetary mode and a rigid mode, wherein in the planetary mode, while the main shaft rotates, the planetary gears are engaged to rotate each of the plurality of cradles on the respective cradle shafts, and wherein in the rigid mode, the planetary gears are disengaged.

2. The strander apparatus of claim 1 wherein the strander apparatus is a six-position strander, and wherein the plurality of cradles comprises six cradles.

3. The strander apparatus of claim 1, wherein in the rigid mode, the plurality of cradles are pinned to the disk.

4. The strander apparatus of claim 1, wherein the dispensed cable comprises at least one of wire, glass, plastic, and fibers.

5. The strander apparatus of claim 1, wherein when operating in the planetary mode the cradles of the plurality of cradles maintain a same orientation relative to a particular plane.

6. The strander apparatus of claim 1, wherein when operating in the rigid mode the cradles of the plurality of cradles maintain a same orientation relative the main shaft.

7. The strander apparatus of claim 1, wherein each of the cradles further comprises a dancer assembly.

8. The strander apparatus of claim 7, wherein each of the cradles further comprises a wireless module, wherein the wireless module is associated with at least one of the cradle, reel, and dancer assembly.

9. The strander apparatus of claim 8, further comprising a controller, wherein the controller communicates with at least one of the cradle, the reel, or the dancer assembly with the associated wireless module.

10. The strander apparatus of claim 1, wherein the strander apparatus is disposed in-line with a second strander apparatus such that the strander apparatus produces a stranded cable that is used as a core about which the second strander dispenses additional cables.

11. A strander apparatus, comprising:

a disk;

a plurality of cradles, each of the cradles comprises a reel and a cradle shaft, the cradle shaft extending in an axial direction from the disk, wherein each reel dispenses cable;

a main shaft, wherein the cradles are disposed on the cradle shafts radially about the main shaft; and planetary gears disposed between the main shaft and respective cradle shafts, wherein the strander operates in one of a planetary mode and a rigid mode, wherein in the planetary mode, while the main shaft rotates, the planetary gears are engaged to rotate each of the plurality of cradles on the respective cradle shafts, and wherein in the rigid mode, the planetary gears are disengaged;

wherein each cradle comprises:

a reel motor;

a dancer;

a dancer motor;

a loadcell; and a cradle controller, wherein the reel motor and the dancer motor are controlled by the cradle controller, and wherein the strander apparatus further comprises:

a main shaft;

a cradle motor; and a main controller, wherein the cradle motor rotates the main shaft and the plurality of cradles which are disposed thereabout, and wherein the respective cradle controllers and the cradle motor are wirelessly controlled by the main controller.

12. A strander apparatus, comprising:

a disk;

a plurality of cradles, each of the cradles comprises a reel and a cradle shaft, the cradle shaft extending in an axial direction from the disk, wherein each reel dispenses cable;

a main shaft, wherein the cradles are disposed on the cradle shafts radially about the main shaft; and planetary gears disposed between the main shaft and respective cradle shafts, wherein the strander operates in one of a planetary mode and a rigid mode, wherein in the planetary mode, while the main shaft rotates, the planetary gears are engaged to rotate each of the plurality of cradles on the respective cradle shafts, and wherein in the rigid mode, the planetary gears are disengaged;

wherein the strander apparatus further comprises:

at least one controller;

a plurality of loadcells associated with the plurality of cradles and disposed proximal to the cradle shafts, wherein each loadcell of the plurality of loadcells includes at least one sensor in wireless communication with the at least one controller; and wherein each reel is wirelessly controlled by the at least one controller in response to the at least one sensor of the loadcells.

13. A method of producing stranded cables, comprising:

rotating a main shaft of a first strander with a plurality of cradles disposed thereabout wherein each cradle comprises a reel motor, a dancer, a dancer motor, a loadcell, and a cradle controller, wherein the reel motor and the dancer motor are controlled by the cradle controller;

dispensing first cable from respective reels disposed on each of the plurality of cradles; and operating the first strander in one of a planetary mode and a rigid mode, wherein in the planetary mode, planetary gears engage the plurality of cradles such that the cradles are rotated coincident with the main shaft, and wherein in the rigid mode, the planetary gears are disengaged and the plurality of cradles is maintained in a same orientation relative the rotating main shaft.

14. The method of producing stranded cables of claim 13, wherein in the planetary mode the dispensed cable is twisted about an axis of the main shaft.

15. The method of producing stranded cables of claim 13, wherein in the rigid mode the dispensed cable is twisted relative to an axis thereof and about an axis of the main shaft.

16. The method of producing stranded cables of claim 13, wherein rotation of the main shaft and cable dispensing from the respective reels are controlled by a main controller.

17. The method of producing stranded cables of claim 13, further comprising:

controlling each of the plurality of cradles with a main controller; and communicating control information to each of the plurality of cradles over a wireless network.

18. The method of producing stranded cables of claim 13, wherein in the rigid mode the plurality of cradles are pinned to a disk disposed on the main shaft.

19. The method of producing stranded cables of claim 13, wherein in the planetary mode a plurality of gears translate rotation of the main shaft to the plurality of cradles.

20. The method of producing stranded cables of claim 13, wherein a second strander is aligned in tandem with the first strander.

21. The method of producing stranded cables of claim 20, wherein a stranded cable dispensed from the first strander is a core about which second cables in the second strander are stranded.

22. The method of producing stranded cables of claim 21, wherein tension of the first cables and tension of the second cables are independently controlled.

23. The method of producing stranded cables of claim 20, wherein the stranded cable dispensed from the first strander is supplied to a hollow center of a main shaft of the second strander.

24. The method of producing stranded cables of claim 20, wherein the first strander and the second strander are independently operated in the rigid mode or the planetary mode.

25. A stranding system, comprising:

a main shaft;

at least one cradle disposed along the main shaft, each cradle includes:

at least one reel and reel motor;

at least one load cell and sensor;

at least one dancer assembly including a dancer motor; and at least one wireless module, wherein the at least one wireless module is associated with at least one of the cradle, reel, load cell, and dancer assembly; and at least one controller;

wherein the controller communicates with the at least one cradle, the at least one reel, or the at least one dancer assembly with the associated at least one wireless module, and wherein the controller operates at least one of the reel motor and the dancer motor.

26. The stranding system of claim 25, wherein the stranding system is a six-position strander.

27. The stranding system of claim 26, wherein the at least one cradle comprises six cradles.

28. The stranding system of claim 27, wherein the controller is a main controller, wherein each of the at least one cradle has a cradle controller, and wherein each cradle controller is wirelessly controlled by the main controller.

29. The stranding system of claim 28, wherein feedback is received from one of the at least one reel, the at least one load cell, and the at least one dancer assembly by the cradle controller, and wherein the cradle controller wirelessly transmits the feedback to the main controller.

30. The stranding system of claim 27, wherein the stranding system operates in a planetary mode or a rigid mode.

31. A strander, comprising:

one or more cradles, each cradle comprising:

a reel;

a reel motor;

a dancer;

a dancer motor;

a loadcell; and a cradle controller, wherein the reel motor and the dancer motor are controlled by the cradle controller;

a main shaft;

a cradle motor; and a main controller, wherein the cradle motor rotates the main shaft and the one or more cradles which are disposed thereabout, and wherein the respective cradle controllers and the cradle motor are wirelessly controlled by the main controller.

32. The strander of claim 31, further comprising a plurality of gears for engaging the one or more cradles.

33. The strander of claim 32, further comprising more than one operational mode.

34. The strander of claim 33, wherein the more than one operational mode comprise a planetary mode and a rigid mode.

35. The strander of claim 34, wherein the plurality of gears engage the one or more cradles during operation of the strander in the planetary mode.

36. The strander of claim 35, wherein the plurality of gears are disengaged with the one or more cradles during operation of the strander in the rigid mode.

37. The strander of claim 36, further comprising at least one disk disposed on the main shaft proximal the one or more cradles.

38. The strander claim 37, wherein the one or more cradles are pinned to the at least one disk during operation in the rigid mode.

39. The strander of claim 31, wherein each of the cradle controllers associated with each of the one or more cradles further comprises a wireless module.

40. The strander of claim 39, wherein feedback from one of the reel motor, the dancer motor, and the loadcell is wirelessly transmitted to the main controller.

41. The strander of claim 40, wherein the reel motor, the dancer motor, and the loadcell are synchronized by the main controller.

42. A control system for a strander, comprising:

at least one controller, wherein the at least one controller further comprises a plurality of cradle controllers and a main controller, wherein the plurality of cradle controllers wirelessly communicate with the main controller;

a plurality of wireless modules;

a plurality of cradles disposed about respective cradle shafts;

a plurality of loadcells associated with the plurality of cradles and disposed proximal the cradle shafts, wherein each loadcell of the plurality of loadcells includes at least one sensor in wireless communication with the at least one controller; and a plurality of reels disposed on respective cradles of the plurality of cradles;

wherein the plurality of reels are wirelessly controlled by the at least one controller in response to the at least one sensor of the loadcells; and wherein the control system further comprises a plurality of motors controlled by each of the plurality of cradle controllers.

43. The control system of claim 42, wherein each of the plurality of cradles further comprise one or more motors controlled by the respective cradle controller of the plurality of cradle controllers.

44. The control system of claim 43, wherein each of the plurality of motors is wirelessly controlled by the main controller.

45. The control system of claim 44, wherein the plurality of motors comprises at least a cradle motor, a reel motor, and a dancer motor.

* * * * *